US006510830B2

(12) United States Patent
Rossiter

(10) Patent No.: US 6,510,830 B2
(45) Date of Patent: Jan. 28, 2003

(54) METHOD AND APPARATUS FOR A LUBRICANT CONDITIONING SYSTEM

(76) Inventor: David Rossiter, 209 Garrison Chase, Senoia, GA (US) 30276

( * ) Notice: Subject to any disclaimer, the term of this patent is extended or adjusted under 35 U.S.C. 154(b) by 0 days.

(21) Appl. No.: 09/834,818

(22) Filed: Apr. 13, 2001

(65) Prior Publication Data

US 2002/0148433 A1 Oct. 17, 2002

(51) Int. Cl.[7] ..... F01M 1/00
(52) U.S. Cl. ..... 123/196 AB; 123/41.33
(58) Field of Search ..... 123/196 AB, 41.33; 165/51; 184/104.3

(56) References Cited

U.S. PATENT DOCUMENTS

| | | | | |
|---|---|---|---|---|
| 3,824,980 A | * | 7/1974 | Hollins | 123/196 AB |
| 3,830,289 A | * | 8/1974 | Olson | 165/119 |
| 4,426,965 A | * | 1/1984 | Patel | 123/196 AB |
| 4,815,431 A | | 3/1989 | Yorita | |
| 4,909,205 A | | 3/1990 | Bewley | |
| 490,114 A | | 7/1990 | Albrecht | |
| 4,967,835 A | | 11/1990 | Lefeber | |
| 5,452,695 A | | 9/1995 | Bedi | |
| 5,460,097 A | | 10/1995 | Nekola | |
| 5,682,851 A | | 11/1997 | Breen | |

* cited by examiner

*Primary Examiner*—Noah P. Kamen
(74) *Attorney, Agent, or Firm*—Patent Focus, Inc.; Richard C. McComas

(57) ABSTRACT

A lubricant conditioning system with a lubricant filtering subsystem mounted to a thermal conditioning subsystem. The lubricant filtering subsystem is in lubricant communication with a lubricant distribution subsystem. The thermal conditioning subsystem is in fluid communication with an internal combustion engine's cooling system. Upon activating or starting the engine 11 and activating the lubricant conditioning system via a switch, a thermally controlled conduit begins heating the lubricant in the engine's lubricant sump. The lubricant is pumped through the lubricant distribution subsystem and is circulated throughout the engine's lubrication system. As the engine is operated, the engine's lubricant is pumped into the lubricant filtering subsystem. The lubricant filtering subsystem filters the lubricant. When the engine reaches normal operating temperature, the coolant is sufficiently heated and an inline thermostat is activated enabling coolant to circulate internally about the thermal conditioning subsystem thereby cooling the lubricant.

17 Claims, 8 Drawing Sheets

METHOD AND APPARATUS FOR A LUBRICANT CONDITIONING SYSTEM

FIELD OF THE INVENTION

The invention relates, in general, to a lubricant conditioning system. In particular, the invention relates to a lubricant conditioning system for an internal combustion engine. More particularly the invention relates to a lubricant conditioning system having a plurality of subsystems controlling the thermal aberrations of the lubricant in the internal combustion engine.

BACKGROUND OF THE INVENTION

An internal combustion engine is typically mounted or installed in a vehicle used to transport products or people. Examples of vehicles are automobiles, trucks, airplanes, boats, etc. To propel a particular vehicle, the internal combustion engine generates power that is transformed into motion or torque. Typically, the torque is transferred to a drive train that propels the vehicle. The internal combustion engine operates or functions in the delivery of power to the drive train through a plurality of moving parts that require lubrication to maintain operable working performance. The required lubrication is supplied to the moving parts by the engine's internal lubrication system. The lubrication system may, if desired, comprise a lubricant sump and a lubricant pump disposed within the confines of the lubricant sump. Typically, the lubricant pump provides the lubricant to the highest internal point or points requiring lubrication. Typically, the highest point or points of the engine are the rocker arm or overhead cam assembly The lubricant is then gravity fed to the lowest point requiring lubrication and finally returns to the lubricant sump.

The internal combustion engine, in the course of operation, generates energy that is not completely converted into torque for the drive train. The unconverted energy is dissipated by the engine in the form of heat. In an effort to maximize the operating capacity of the engine, the generated heat is transferred to a coolant. The coolant via a heat exchanger dissipates the heat into the atmosphere. Lubricant also acts as a coolant to the internal combustion engine. However, transferring energy to lubricant in the form of heat causes the viscosity of the lubricant to decrease i.e. the flow rate of the lubricant increases. The increase in temperature is reflected in a decrease of the effectiveness of the lubricant. Lubricant that has a relative high viscosity lubricates moving parts or assembles to a higher degree than lubricant that has a relatively low viscosity.

Resolution of the above discussed dichotomy has been attempted in the past. Efforts have produced a heat exchanger, air cooled pumping mechanisms, and heated lubrication mechanisms all of which proved to be inadequate in compensating for the dichotomy of a need for lubrication versus decreased lubrication due to heat.

It would be desirable to have lubricant conditioning system that thermally manages or controls the temperature, viscosity, and filtering of lubricant for an internal combustion engine. It would be further desirable for the lubricant conditioning system to be adaptable to any type of internal combustion engine.

SUMMARY OF THE INVENTION

The present invention is a lubricant conditioning system to thermally manage or control the temperature, viscosity, evacuation, and filtering of lubricant for an internal combustion engine. The present invention is adaptable to any type of internal combustion engine. The internal combustion engine may, if desired, be air cooled or water cooled. Typically, the internal combustion engine has an engine lubricant sump to receive and store engine lubricant and a lubricant filter housing to attach a lubricant filter or filters.

The present invention has a lubricant distribution subsystem that is operationally mounted to the internal combustion engine's lubricant filter housing and the engine's lubricant sump. The present invention further comprising a lubricant filtering subsystem and a thermal conditioning subsystem integrated thereto. The lubricant filtering subsystem is in lubricant or fluid communication with the lubricant distribution subsystem. A lubricant filtering subsystem outtake manifold is operationally disposed within the confines of the thermal conditioning subsystem. The thermal conditioning subsystem is operationally disposed about the lubricant filtering subsystem outtake manifold. The temperature of the thermal conditioning subsystem disposed about the lubricant filtering subsystem's outtake manifold may, if desired, be selectively adjusted to control the thermal aberrations of the lubricant prior to redistribution of the lubricant by the lubricant distribution subsystem.

In the preferred embodiment of the present invention the lubricant filtering subsystem is mounted onto the thermal conditioning subsystem wherein the lubricant filtering subsystem is in lubricant or fluid communication with the lubricant distribution subsystem and the thermal conditioning subsystem is in fluid communication with the engine's cooling system. Typically, the engine will be cold due to suspended activity. The lubricant in the engine while in the cooling process will migrate or drip into the lubricant sump via the galleries or capillaries inherent to an internal combustion engine's lubrication system. Once the engine is cooled or cold, the lubricant increases its viscosity with the decrease in temperature i.e., lubricant viscosity is inversely related to temperature.

Upon activating or starting the cold internal combustion engine and activating the present invention via a switch, a thermally controlled conduit begins heating the lubricant in the lubricant sump. Since lubricant viscosity is inversely related to temperature, the lubricant's viscosity decreases. The lubricant is pumped through the lubricant distribution subsystem via a valve and is circulated throughout the internal combustion engine's lubrication system. As the engine is operated, the engine's lubricant is pumped to the lubricant filtering subsystem. The lubricant filtering subsystem filters the lubricant. The lubricant is then pumped to the internal combustion engine's lubrication system. The engine increases in its operation capacity thereby heating its associated coolant. When the engine's coolant is sufficiently heated, an inline thermostat is activated enabling coolant to circulate about the outtake manifold thereby cooling the lubricant. The cooled lubricant is then pumped to the engine's lubrication system.

The second embodiment of the present invention comprises a lubricant filtering subsystem connected to a heat exchanger. The heated or hot lubricant is received from the engine's lubrication system or from the lubrication distribution subsystem via a conduit. The heated lubricant is filtered by at least one inverted lubricant filter. The filtered lubricant is distributed to the heat exchanger via an outtake manifold. The filtered lubricant is cooled in the heat exchanger by the flow of air, either fan driven or ambient. Ambient airflow may consist of ducting or venting to derive cooling air from vehicle motion.

The third embodiment of the present invention enables the user of the present invention to adapt or connect the present invention directly to the internal combustion engine via the lubricant distribution subsystem. The lubricant subsystem comprises a sump pump connected to a pair of valves. The valves may, if desired, be manual, electrical, or electromechanically operated solenoids. One end of a thermally controlled conduit is connected to the sump pump. The other end of the thermally controlled conduit is connected to the lubricant sump.

The command and control of the third embodiment of the present invention may, if desired, be via a plurality of controls that actuate the valves or solenoids. A normally open switch is connected to one of the valves and the sump pump. The first switch may, if desired, be activated or closed thereby starting the lubricant evacuation of the engine. A second normally open switch is connected to a pair of valves. If desired, the second switch may be activated or closed thereby activating the preheating of the lubricant.

The fourth embodiment of the present invention 10 is a switch operated lubricant conditioning system. The lubricant filtering subsystem and the thermal conditioning subsystem are configured in the same manner as was discussed in the preferred embodiment of the present invention. A heat exchanger is mountably disposed to the thermal conditioning subsystem and the lubricant distribution system. An electric fan may, if desired, be operationally installed on the heat exchanger. The electric fan receives its power via the vehicle's engine. The fourth embodiment receives hot lubricant from the lubricant distribution system and is cooled by the combination of the heat exchanger and the fan. After the lubricant is cooled it is pumped to the lubricant filtering subsystem wherein the cooled lubricant is filtered. After the filtering of the lubricant, the lubricant traverses through a conduit to the lubricant distribution system for re-entry into the internal combustion engine.

A three-way switch is mounted onto the thermal conditioning subsystem. The first position of the switch controls the operation of the pump of the lubricant distribution system. In this particular position, the pump is deactivated and the lubricant traverses the engine's lubrication system in a normal manner. The second position of the switch activates the pump to begin the lubricant evacuation from the lubricant sump. The third position of the switch activates the preheating cycle. The preheating cycle electrically disengages the thermal conditioning subsystem and the lubricant filtering subsystem from the lubricant distribution system. The third position also activates the thermally controlled conduit. The preheat cycle heats the lubricant as it is being pumped from the lubricant sump through the lubricant distribution system before returning to the internal combustion engine's lubrication system.

When taken in conjunction with the accompanying drawings and the appended claims, other features and advantages of the present invention become apparent upon reading the following detailed description of embodiments of the invention.

BRIEF DESCRIPTION OF THE DRAWINGS

The invention is illustrated in the drawings in which like reference characters designate the same or similar parts throughout the figures of which.

DETAILED DESCRIPTION OF THE PREFERRED EMBODIMENT OF THE PRESENT INVENTION

Figure 1:
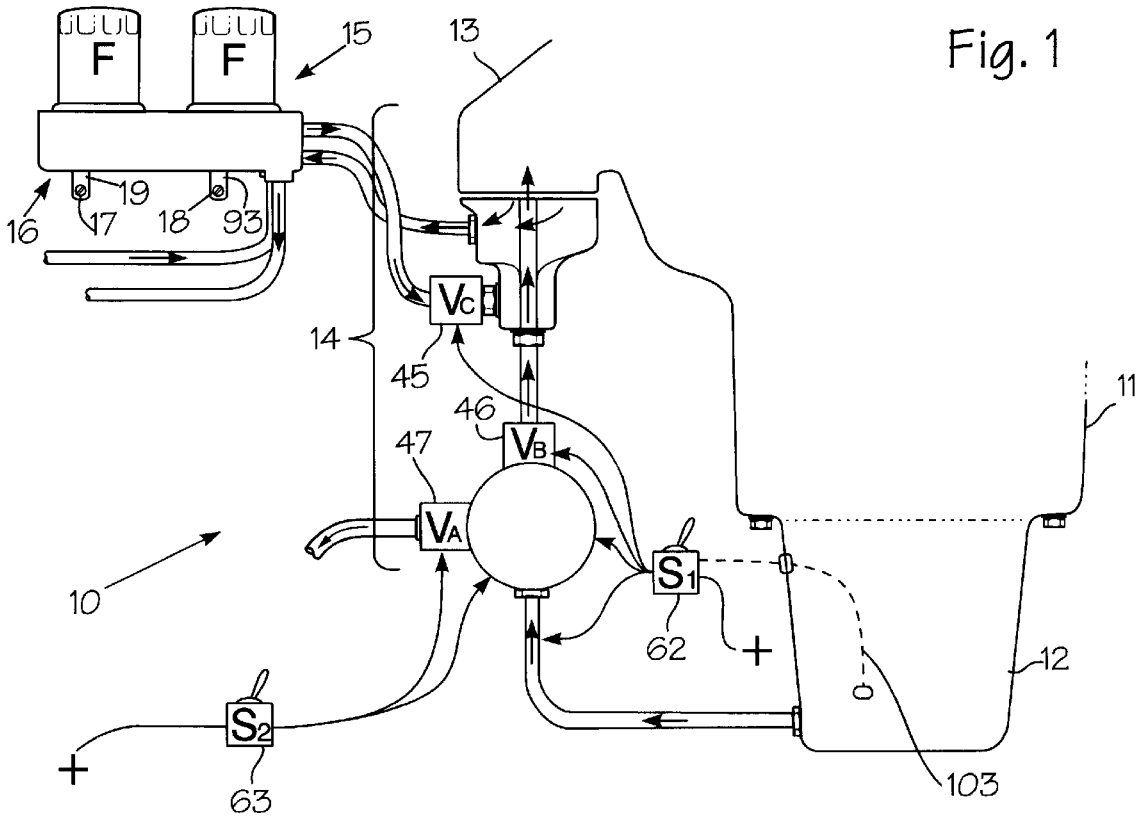
FIG. 1 illustrates a side view of the preferred embodiment of the present invention.

Before describing in detail the particular improved system for thermally conditioning lubricant in accordance with the present invention, it should be observed that the invention resides primarily in a novel structural combination of a conventional internal combustion engine, discrete subsystems or subassembly components, associated control of the aforementioned components, and not in the particular detailed configuration thereof. Accordingly, the structure, command, control, and arrangement of these conventional components and subassemblies have, for the most part, been illustrated in the drawings by readily understandable diagram representations and schematic diagrams. The drawings show only those specific details that are pertinent to the present invention in order not to obscure the disclosure with structural details which will be readily apparent to those skilled in the art and having the benefit of the description herein. For example, an internal combustion engine 11, FIG. 11 has numerous connections to the present invention 10. Various portions of the internal combustion engine connections to the present invention have been simplified in order to emphasize those portions that are most pertinent to the invention. Thus, the top level system diagram and schematic diagram illustrations of the Figures do not necessarily represent the mechanical structural arrangement of the exemplary system, and are primarily intended to illustrate major hardware structural components of the system in a convenient functional grouping whereby the present invention may be more readily understood.

Figure 2:
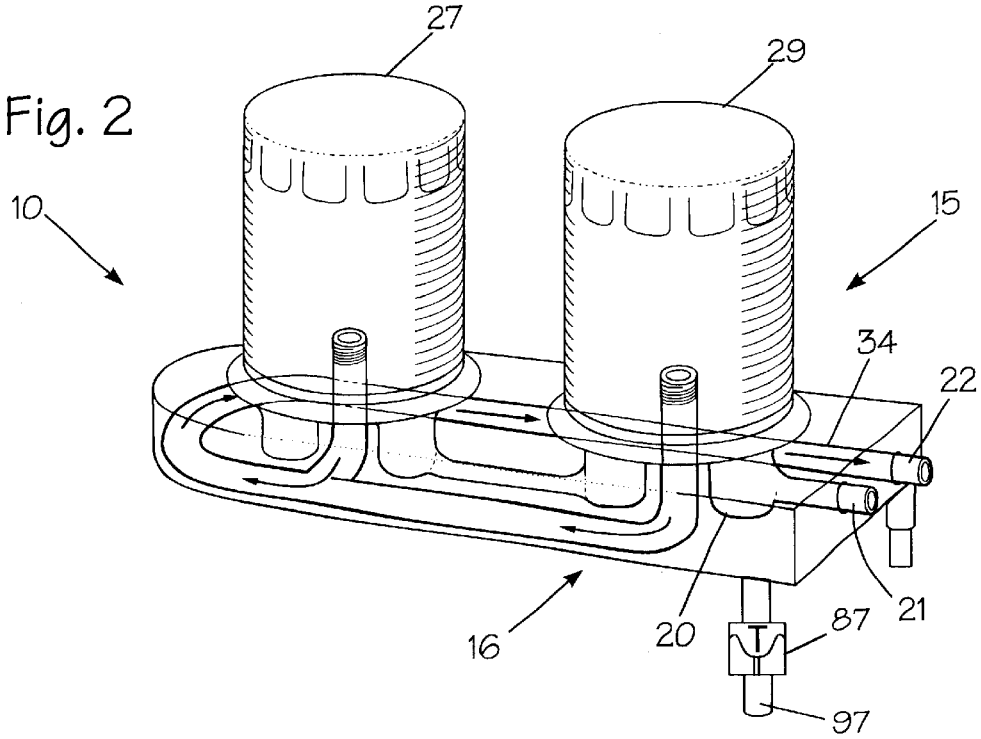
FIG. 2 illustrates a prospective view of the lubricant filtering subsystem operationally disposed to the thermal conditioning subsystem of FIG. 1.

An overview of the present invention 10, FIG. 1. The present invention 10 is a lubricant conditioning system for an internal combustion engine 11. The internal combustion engine 11 has a cooling system (not shown), an engine lubricant sump 12, and a lubricant filter housing 13. The present invention 10 has a lubricant distribution subsystem 14 that is operationally mounted to the internal combustion engine's lubricant filter housing 13 and the engine's lubricant sump 12. The present invention 10 further comprises a lubricant filtering subsystem 15 and a thermal conditioning subsystem 16 integrated thereto. The lubricant filtering subsystem 15 is in lubricant or fluid communication with the lubricant distribution subsystem 14. The thermal conditioning subsystem 16 and the lubricant filtering subsystem 15 may, if desired, be mounted to the internal combustion engine 11 by any convenient means. An example of a mounting means are screws 17 and 18 traversing eyelets 19 and 93 respectively thereby retaining the thermal conditioning subsystem 16 and the lubricant filtering subsystem 15 to any structure, preferably the internal combustion engine 11 or engine's 11 compartment well. A lubricant filtering subsystem outtake manifold 34, FIG. 2 is operationally disposed within the confines of the thermal conditioning subsystem 16, FIG. 2. The thermal conditioning subsystem 16 is operationally disposed about the lubricant filtering subsystem outtake manifold 34. The temperature of the thermal conditioning subsystem 16 disposed about the lubricant filtering subsystem's 15 outtake manifold 34 may, if desired, be selectively adjusted to control the thermal aberrations of the lubricant prior to redistribution of the lubricant by the lubricant distribution subsystem 14, FIG. 1.

Figure 5:
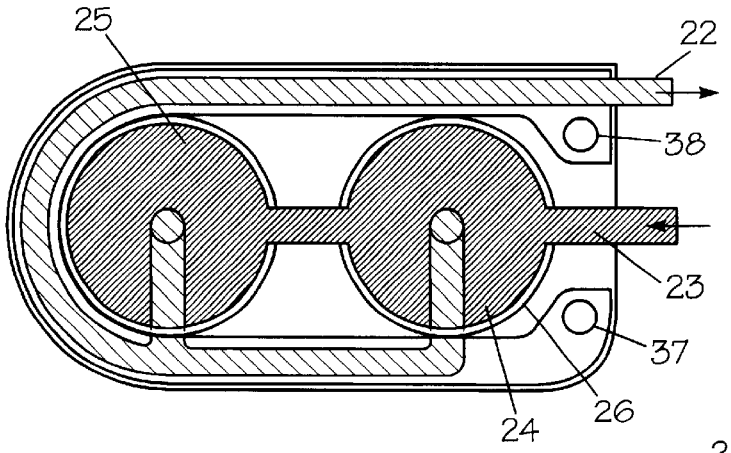
FIG. 5 illustrates a top cutaway view of the lubricant filtering subsystem's intake and outtake manifolds of FIG. 2.

A more detailed discussion of the present invention 10: The lubricant filtering subsystem 15, FIG. 2 may, if desired, have a lubricant intake manifold housing 20, FIG. 2. The intake manifold housing 20 has one end connected to a lubricant intake port 21. The intake manifold 20 has an intake flange 24, FIG. 5 connected along its longitudinal length. If desired a second intake flange 25 or a plurality of intake flanges may be connected along the manifold housing's longitudinal length. Intake flanges 24 and 25 are sized to receive lubricant filters 27 and 28 respectively. Each intake flange 24 or 25 has an outward facing sealing mechanism 26 that prevents lubricant from filters 27 or 28, FIG. 3 from leaking into the surrounding area. An example of the sealing mechanism 26, FIG. 5 is a rubber or neoprene O-ring. The filters 27 or 28, FIG. 3 may, if desired, be inverted as illustrated in FIG. 3 or they may be positioned in any angular position relative to the lubricant intake manifold housing 20.

Figure 3:
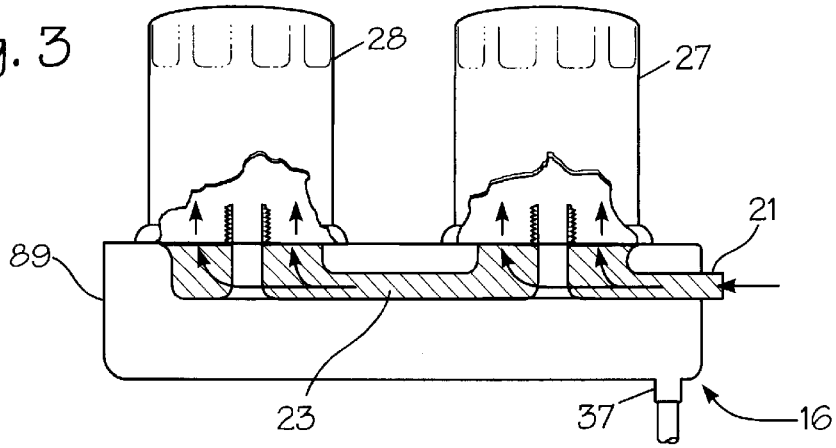
FIG. 3 illustrates a side view of the lubricant filtering subsystem's intake manifold of FIG. 2.
Figure 6:
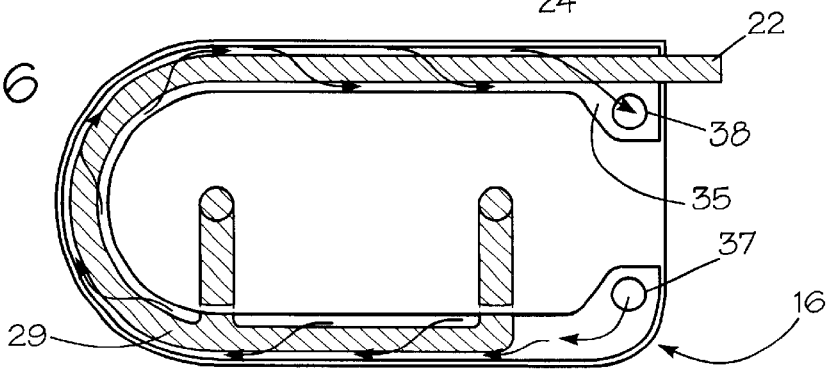
FIG. 6 illustrates a top cutaway view of the thermal conditioning subsystem outtake portion of FIG. 1.

The thermal conditioning subsystem 16, FIG. 3 is incorporated into a substantially rectangular housing 89. A portion of the interior walls of the housing 89 are formed into a coolant chamber 35, FIG. 6. An outtake manifold 29, FIG. 6 has an outer surface 36, FIG. 4*b* that is fluted or arranged in such a manner to increase the external surface area of the outtake manifold 29. The outtake manifold 29 is medially spaced within a coolant chamber 35, FIG. 6. The walls of the coolant chamber 35 separate the intake manifold 23, FIG. 3*a* and the outtake manifold 29. The coolant chamber 35, FIG. 6 has at one end a coolant intake port 37. If desired, a thermostat 87, FIG. 2 may be inserted in-line with the coolant intake port 37 and the coolant intake conduit 97. The thermostat 87 regulates the temperature of the coolant entering the thermal conditioning subsystem 16. The thermostat 87 may, if desired, be selectively adjusted to open or activate in a temperature range of 30° (degrees) C. to about 110° (degrees) C. The other end of the coolant chamber 35 has a coolant outtake or return port 38. The engine's 11 coolant enters the coolant chamber 35 via the coolant intake port 37 circulates about the outtake manifold 29 and exits via outtake port 38. During the coolant flow through the coolant chamber 35 energy in the form of heat is transferred from the heated lubricant within the confines of the outtake manifold 29 to the engine's 11 coolant system.

Figure 4A:
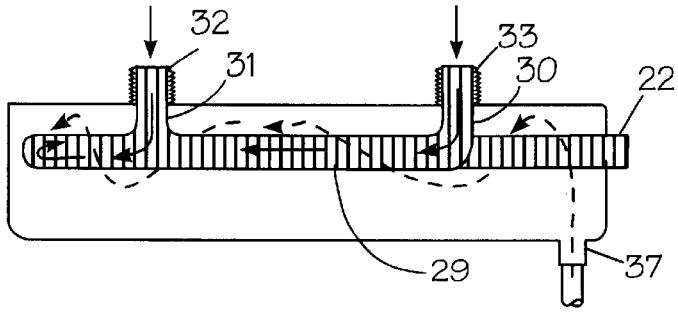
FIG. 4*a* illustrates a side cutaway view of the lubricant filtering subsystem's outtake manifold of FIG. 2.
Figure 4B:
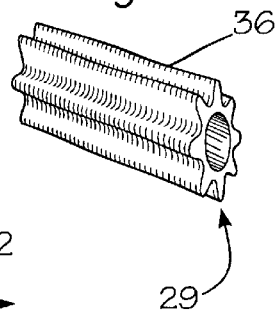
FIG. 4*b* illustrates a perspective view of the corrugated surface of the outtake manifold of FIG. 4*a,*

The outtake manifold 29, FIG. 4*a* has one end connected to a lubricant outtake port 22. The outtake manifold 29 is terminated into a tubular extension 30. The tubular extension 30 may, if desired, be in an angular relationship with the outtake manifold 29. For example, the tubular extension 30 is connected at 90° (degrees) relative to outtake manifold 29. If desired a second tubular extension 31 or a plurality of tubular extensions may be connected along the longitudinal length of the outtake manifold 29. Each tubular extension 30 or 31 is coaxially positioned relative to each intake flange 24 or 25, respectively. Each tubular extension 30 or 31 has one end threaded 33 and 32, respectively. The threaded end 32 or 33 is screwed into the filters 28 or 27, respectively. The tightening action of filters 27 or 28 secures the sealing mechanism 26 thereby preventing unwanted lubricant leakage from the filters.

Figure 7:
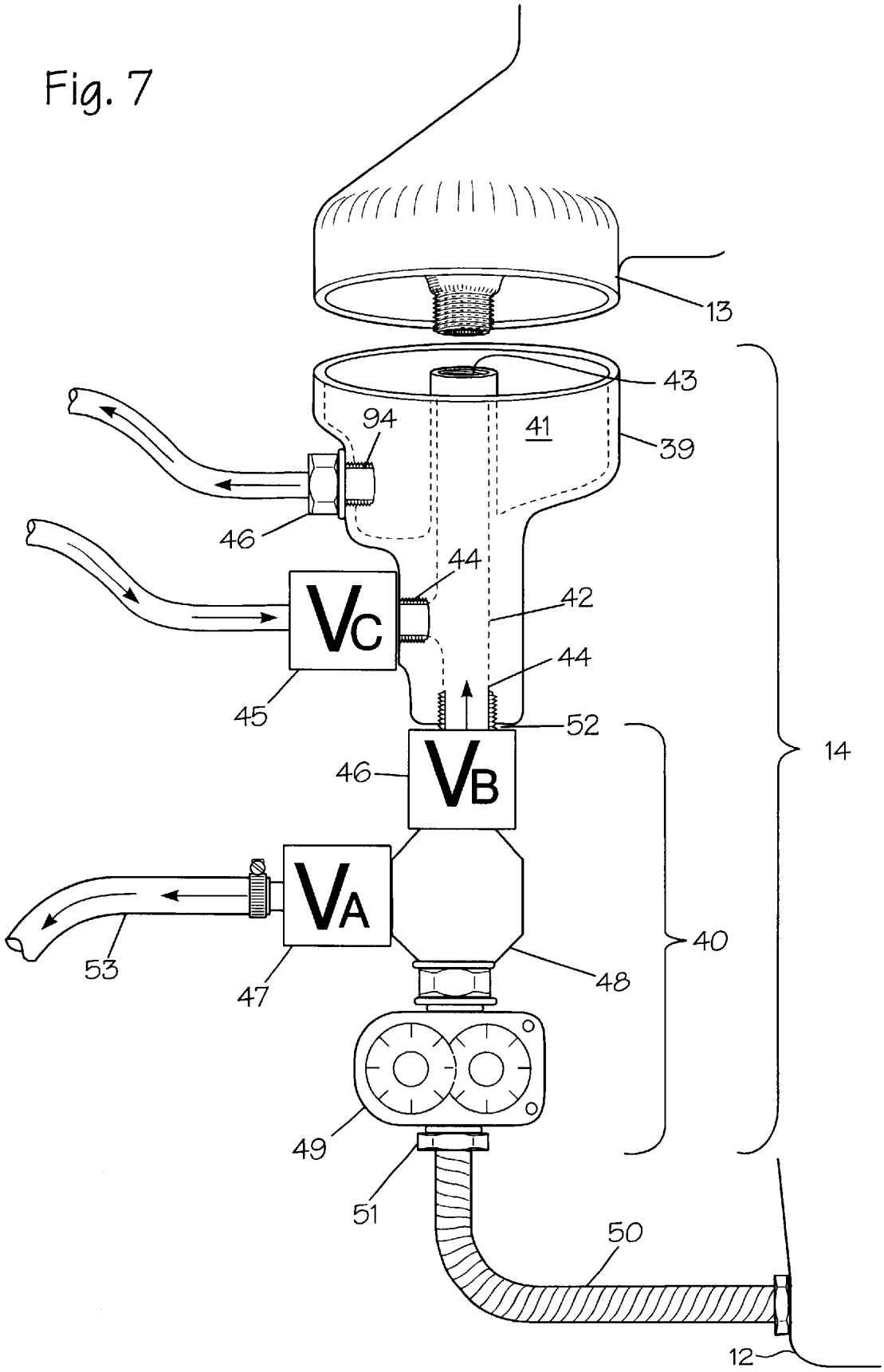
FIG. 7 illustrates a side view of the lubricant distribution subsystem of FIG. 1.

The lubricant distribution subsystem 14, FIG. 7 is adapted to be mounted on any lubricant filter housing 13. The lubricant distribution subsystem 14 comprises at one end a substantially cylindrical housing 39. A portion of the interior walls of the cylindrical housing 39 form at one end a lubricant receiving well 41. The lubricant receiving well 41 has a lubricant outtake port 94 whereby lubricant received in the receiving well 41 is transferred under pressure from the engine's 11 lubricant pumping system to the lubricant filtering subsystem 15.

A distribution conduit 42, FIG. 7 is coaxially spaced within the confines of the cylindrical housing 39. The distribution conduit 42 coaxially traverses the lubricant receiving well 41. The distribution conduit 42 has one end 91 that is internally threaded for mounting to the lubricant filter housing 13. The other end of the distribution conduit 42 is externally threaded for connecting to a pump evacuation unit 40. The distribution conduit 42 has a tubular extension 44 mounted along its longitudinal length. The tubular extension 44 is threaded for receiving one side of a valve 45. The valve 45 may, if desired, be a manually operated valve, electrically actuated solenoid valve, or any other type of convenient valve. The other side of the valve 45 is connected to the lubricant filtering subsystem's 15 outtake port 22.

The pump evacuation unit 40, FIG. 7 has in combination a pair of valves 45 and 46, pump 49, and a lubricant receiving manifold 48. The lubricant receiving manifold 48 has a portion of its interior walls formed into a chamber for retaining lubricant. The pump evacuation unit 40 has a first end 51. The first end 51 is connected to the engine's 11 lubricant sump 12 by a thermally controlled tubular conduit 50. The pump evacuation unit 40 is in fluid or lubricant communication with the lubricant sump 12. The pump evacuation unit 40 has a second end 52 that is connected to the distribution conduit 42 via one side of a valve 46. The valve 46 may, if desired, be a manually operated valve, electrically actuated solenoid valve, or any other convenient type of valve. The other side of the valve 46 is connected to the lubricant receiving manifold's 48 internal chamber via an intake port. The pump 49 is connected to the lubricant receiving manifold's 48 internal chamber via a second intake port. The lubricant receiving manifold's 48 internal chamber has a third intake port connected to one side of a valve 47. The other side of the valve 47 is connected to a lubricant evacuation conduit 53. The valve 47 may, if desired, be a manually operated valve, electrically actuated solenoid valve, or any other convenient type of valve. The engine's 11 lubrication system is in fluid or lubricant communication with the present invention 10 via the lubricant distribution subsystem 14.

The command and control of the present invention 10, FIG. 1 may, if desired, be via a plurality of controls that actuate the valves or solenoids 45, 46, and 47. A normally open switch 63 is connected to the valve 47 and the pump 49. If desired, the switch 63 is activated or dosed thereby starting the lubricant evacuation of the engine 11. A normally open switch 62 is connected to the valves 45 and 46. If desired, the switch 62 is activated or closed thereby activating the preheating of the lubricant (discussed below).

Figure 8:
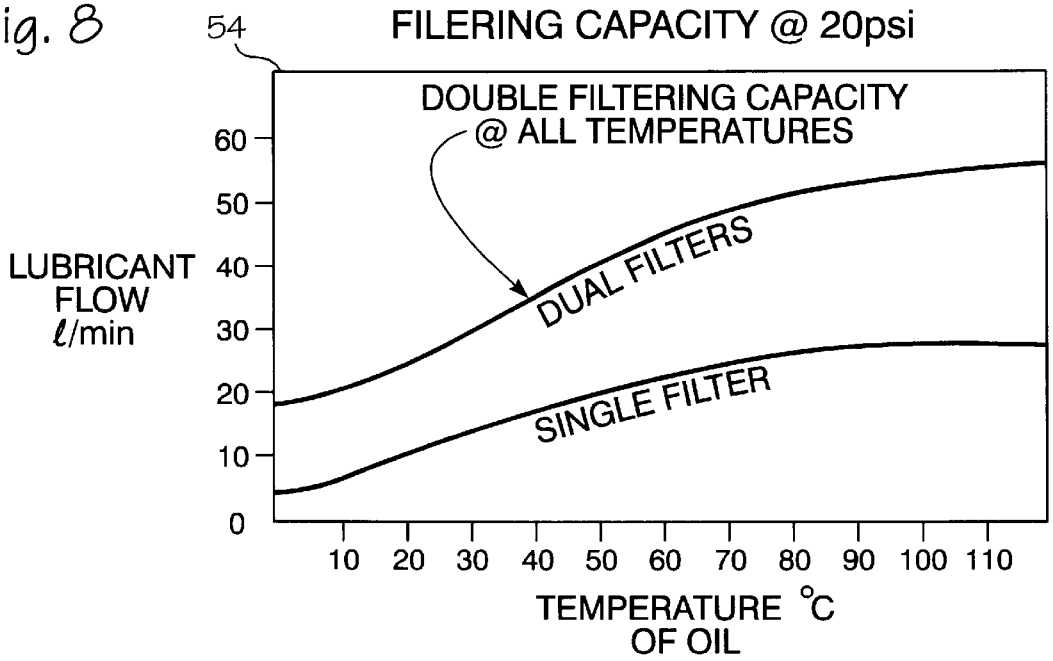
FIG. 8 illustrates a graph depicting Filtering Capacity.
Figure 9:
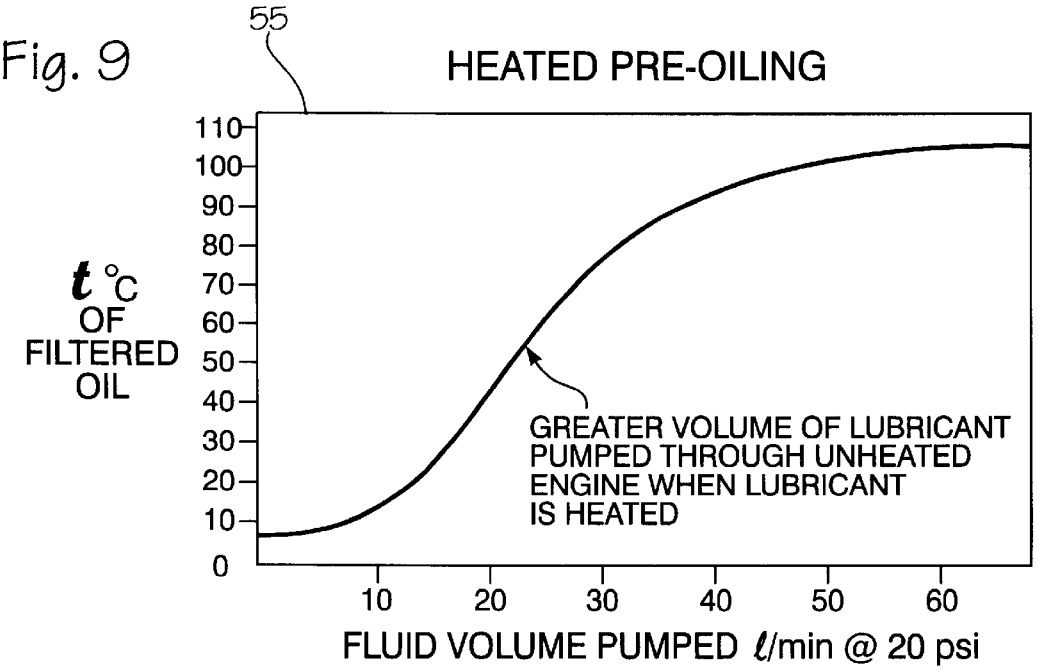
FIG. 9 illustrates a graph depicting Heated Pre-Oiling.
Figure 10:
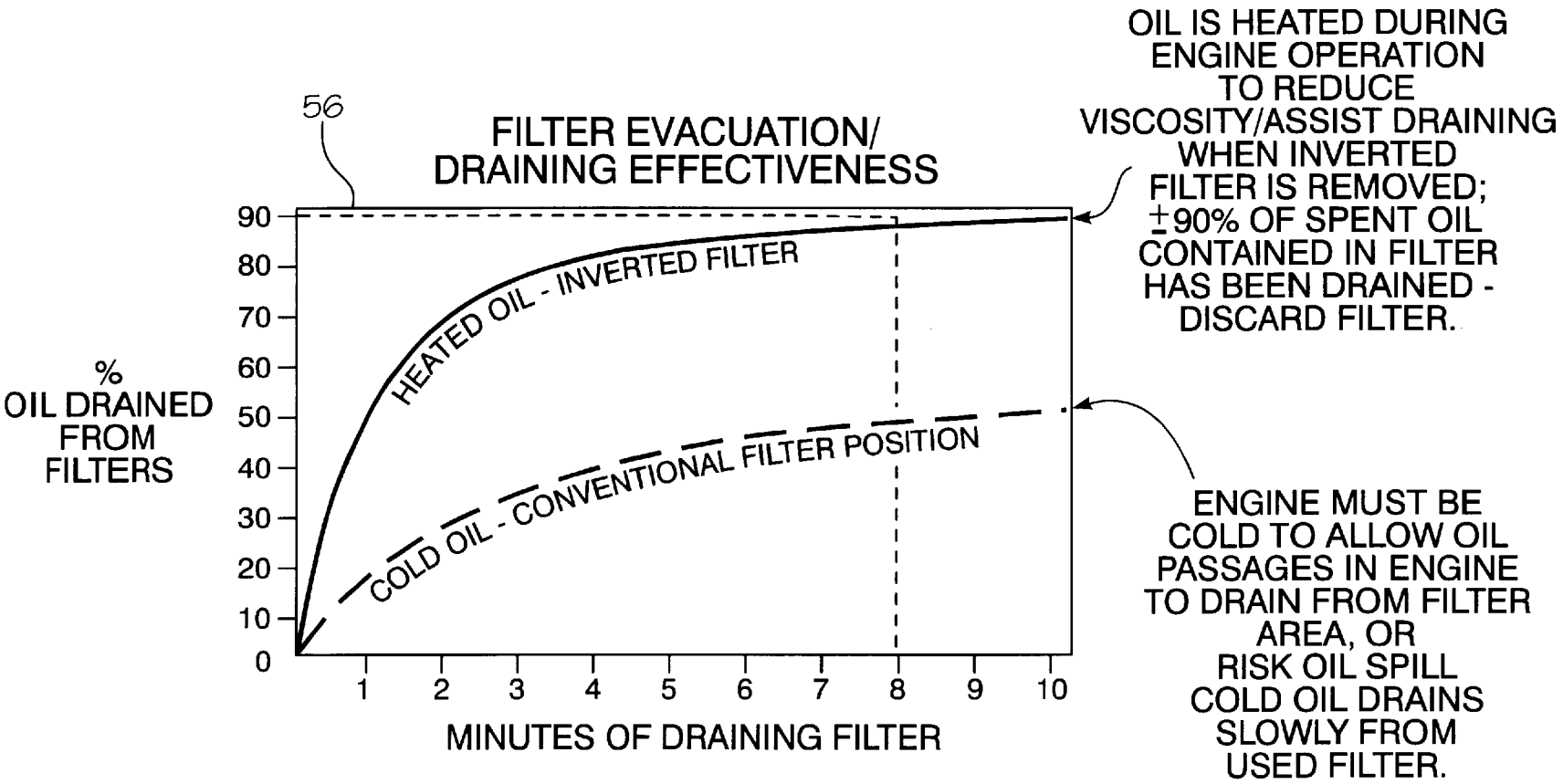
FIG. 10 illustrates a graph depicting Filter Evacuation/Draining Effectiveness.

The dichotomy of lubricating an internal combustion engine is that the lubrication of the engine is maximized at high viscosity and low temperature of the lubricant but the flow of the lubricant is maximized at high temperature and low viscosity 54, FIG. 8. When the engine 11 is cold i.e., normal operating temperature has not been obtained, the present invention 10 preheats the lubricant provided to the engine's 11 lubrication system. The preheating of the lubricant produces a greater volume of lubricant 55, FIG. 9 through the engine 11. Preheating cold lubricant increases the flow of the lubricant thereby protecting the engine's moving parts while the engine is warming to its normal operating temperature. When the engine 11 reaches its normal operating temperature, the present invention 10 begins cooling the lubricant to maximize the lubrication efficiency of the lubricant. The preheating of the lubricant may, if desired, be used when evacuating the lubricant from the engine 11. Lubricant evacuation from engine 11 is maximized when the engine's lubricant has completely drained into the engine's lubrication sump 12, i.e. the engine 11 and the lubricant are cold. However, as discussed above lubricant flow is maximized when the lubricant is heated or at elevated temperatures. The present invention 10 preheats the lubricant during the lubricant evacuation process therefore the engine 11 may be cold but the lubricant is heated to increase the efficiency of lubricant evacuation 56, FIG. 10.

Figure 11:
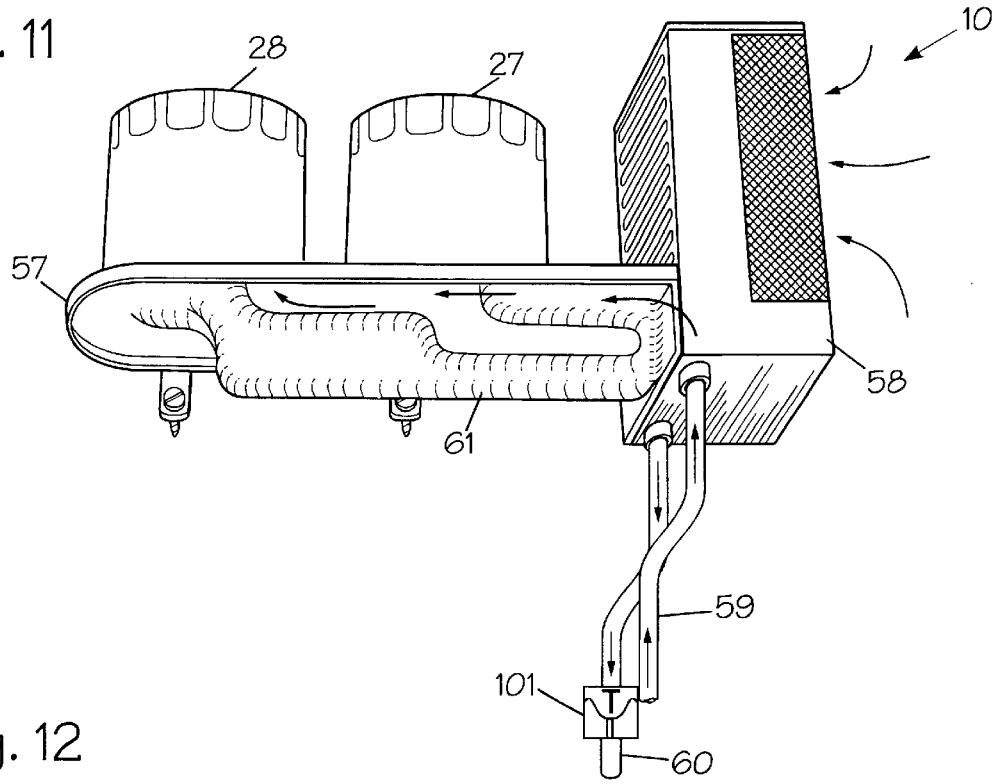
FIG. 11 illustrates a second embodiment of the present invention.

The second embodiment of the present invention 10, FIG. 11 comprises a lubricant filtering subsystem 57 connected to a heat exchanger 58. Hot lubricant is received from the engine's 11 lubrication system or from the lubrication distribution subsystem 14 via conduit 59. The hot lubricant is filtered by at least one inverted lubricant filter 28 and if desired, by inverted lubricant filter 27. The filtered lubricant is distributed to the heat exchanger 58 via an outtake manifold 61. The filter lubricant may, if desired, be cooled by a fan enclosed within or adjacent to the heat exchanger 58 and the lubricant is returned to the engine's 11 lubrication system via conduit 60. The conduit 60 has an inline thermostat 101 to control the starting and stopping of the fan. The fan is deactivated by the thermostat 101 if the lubricant is below a selected temperature thereby turning off the fan, allowing the lubricant to reach operating temperature. Conversely, when the lubricant is sufficiently heated the cooling fan is activated by thermostat 101.

Figure 12:
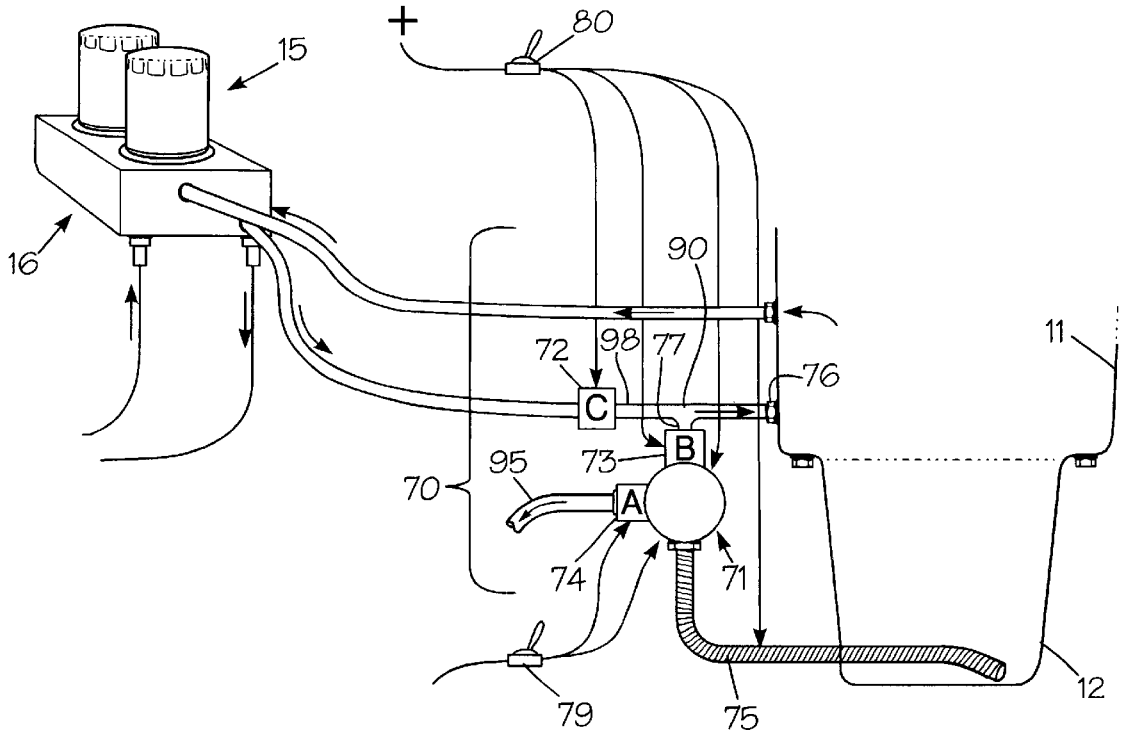
FIG. 12 illustrates a third embodiment of the present invention.

The third embodiment of the present invention 10, FIG. 12 enables the user of the present invention to adapt or connect the present invention 10 directly to the internal combustion engine 11 via the lubricant distribution subsystem 70. The lubricant subsystem 70 comprises a sump pump 71 connected to a pair of valves 73 and 74. The valves 73 and 74 may, if desired, be manual, electrically operated, or electromechanically operated solenoids. One end of a thermally controlled conduit 75 is connected to the sump pump 71 the other end of the thermally controlled conduit 75 is connected to the lubricant sump 12. The valve 74 like valve 47 of the first embodiment of the present invention 10 is connected to a lubricant drain 95.

A tubular manifold 90, FIG. 12 has one end 76 adaptively or mountably connected to the lubrication system of the engine 11. The other end 98 of the tubular manifold 90 is connected to one side of the valve 72. The tubular manifold 90 has a tubular extension 77 mounted along its longitudinal length. The tubular extension 77 is connected one side of the valve 73. The other side of the valve 72 is connected to the thermal conditioning subsystem 16 and the lubricant filtering subsystem 15.

The command and control of the third embodiment of the present invention 10, FIG. 12 may, if desired, be via a plurality of controls that actuate the valves or solenoids 72, 73, and 74. A normally open switch 79 is connected to the valve 74 and the pump 71. If desired, the switch 79 is activated or dosed thereby starting the lubricant evacuation of the engine 11. A normally open switch 80 is connected to the valves 72 and 73. If desired, the switch 80 is activated or closed thereby activating the preheating of the lubricant.

Figure 13:
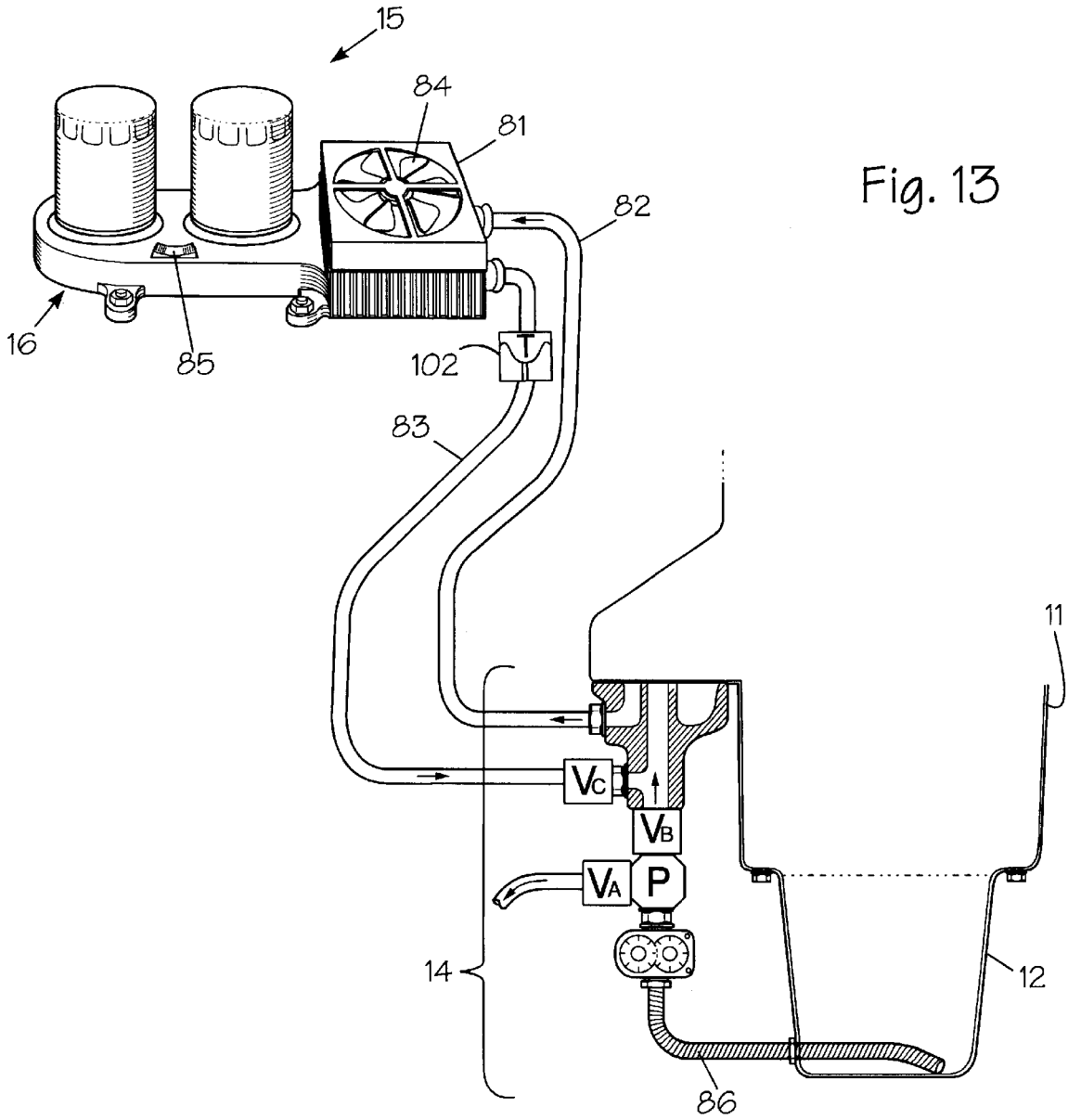
FIG. 13 illustrates a fourth embodiment of the present invention.

The fourth embodiment of the present invention 10, FIG. 13 is a switch operated lubricant conditioning system. The lubricant filtering subsystem 15 and the thermal conditioning subsystem 16 are configured in the same way was discussed in the preferred embodiment of the present invention 10. A heat exchanger 81 has one end connected to one end of the thermal conditioning subsystem 16. The other end of the heat exchanger 81 is connected to the lubricant distribution system 14 via lubricant intake conduit 82 and outtake conduit 83. An electric fan 84 may, if desired, be operationally installed on the heat exchanger 81. The electric fan 84 receives its power via the vehicle containing the engine 11. The electric fan 84 is activated by the thermostat 102 if the lubricant is below a selected temperature thereby deactivating the electric fan 84, allowing the lubricant to reach operating temperature. Conversely, when the lubricant is sufficiently heated the electric cooling fan 84 is activated by thermostat 102. The fourth embodiment receives hot lubricant from the lubricant distribution system 14 and is cooled by the combination of the heat exchanger 81 and the fan 84. After the lubricant is cooled, it is pumped to the lubricant filtering subsystem 15 wherein the cooled lubricant is filtered. After it is filtered, the lubricant traverses conduit 83 to the lubricant distribution system 14 for re-entry into the engine 11.

A three-way switch 85 is mounted onto the thermal conditioning subsystem 16. The first position of the switch 85 controls the operation of the pump of the lubricant distribution system 14. In this particular position, the pump is deactivated and the lubricant traverses the engine's 11 lubrication system in a normal manner. The second position of the switch 85 activates the pump to begin the lubricant evacuation from the lubricant sump 12. The third position of the switch 85 activates the preheating and pre-oiling cycle. The preheating cycle electrically disengages the thermal conditioning subsystem 16 and the lubricant filtering subsystem 15 from the lubricant distribution system 14. The preheated lubricant is pumped directly to the engine's 11 lubrication system thereby pre-oiling the engine. The third position also activates the thermally controlled conduit 86. The preheat cycle heats the lubricant as it is being pumped from the lubricant sump 12 through the lubricant distribution system 14 before returning to the engine's 11 lubrication system.

Figure 14A:
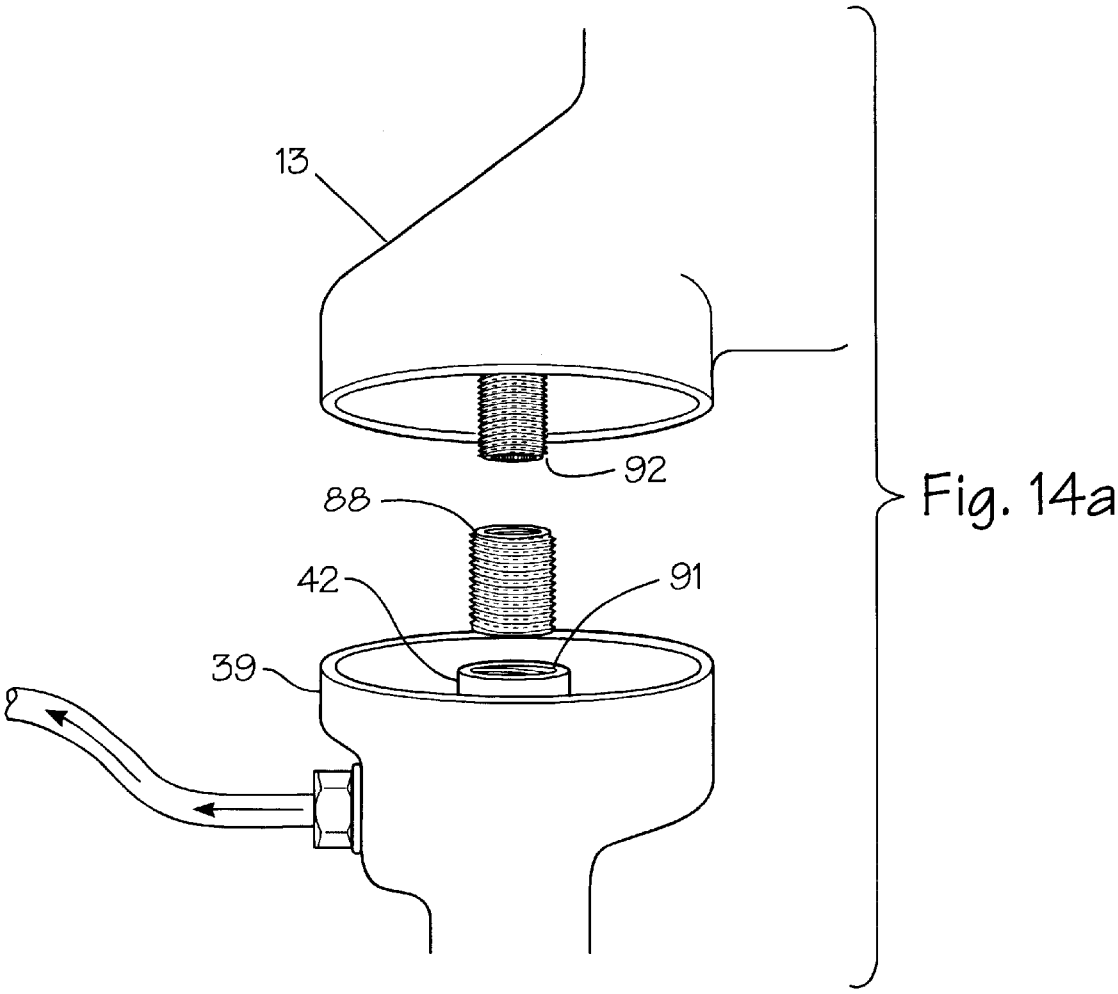
FIG. 14*a* illustrates a perspective view of a universal adapter for the present invention.
Figure 14B:
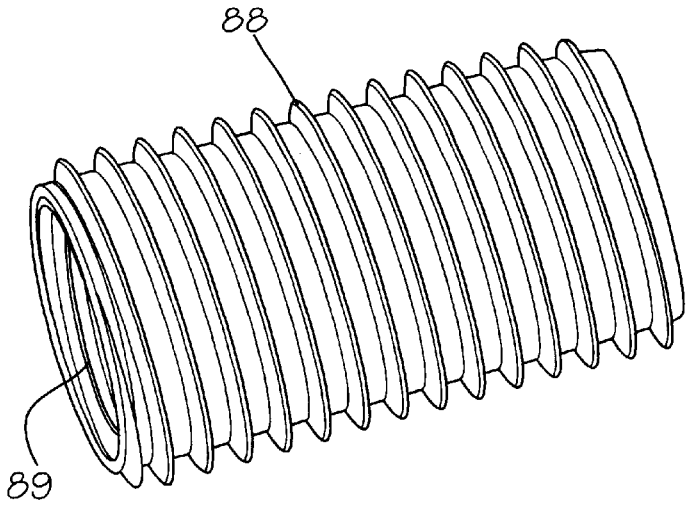
FIG. 14*b* illustrates a perspective view of the threaded portion of the adapted of FIG. 14*a*.

The distribution conduit 43, FIG. 14*a* has one end that is internally threaded 91. The threaded end 91 mates or engages an externally threaded port 92 of the lubricant filter housing 13. Revolving or screwing the substantially cylindrical housing 39 about the threaded port 92 tightens the substantially cylindrical housing 39 to the lubricant filter housing 13. If desired a universal threaded adapter 88, FIG. 14*b* may be inserted into the threaded end 91 of the substantially cylindrical housing 39. The universal adapter 88 may, if desired, be sized to receive a plurality of sizes of threaded ports 92. The universal adapter 88 enables the present invention 10 to be adapted to a plurality of lubricant filter housings 13 disposed on a plurality of different types of engines.

The best mode of operation for the present invention 10, FIG. 1. The lubricant filtering subsystem 15 is mounted onto the thermal conditioning subsystem 16 wherein the lubricant filtering subsystem 15 is in lubricant or fluid communication with the lubricant distribution subsystem 14 and the thermal conditioning subsystem 16 is in fluid communication with the engine's 11 cooling system. Typically, the engine 11 will be cold due to suspended activity. The lubricant in the engine 11, while in the cooling process, will migrate or drip into the lubricant sump 12 via the galleries or capillaries inherent to an internal combustion engine's lubrication system. Once the engine 11 is cooled or cold, the lubricant increases in viscosity with the decrease in temperature i.e., lubricant viscosity is inversely related to temperature.

Upon activating or starting the cold engine 11 and activating the present invention 10 via switch 62, the thermally controlled conduit 86 begins heating the lubricant in the lubricant sump 12. Switch 62 may, if desired, be controlled by a thermal cutout switch 103. The temperature upon which the thermal cutout switch 103 is activated is selected according to the grade of lubricant desired for use in the engine 11. When the temperature is below the selected temperature cutoff, the thermal cutout switch 103 is activated and all functions of switch 62 are suspended except for the thermally controlled conduit 86. Since lubricant viscosity is inversely related to temperature, the lubricant's viscosity decreases i.e., the engine's 11 heated lubricant is pumped through the engine lubrication capillaries, bypassing the filtering and cooling system, and returning to the engine sump 12. The lubricant is pumped through the lubricant distribution subsystem 14 via valve 46 and is circulated throughout the engine's 11 lubrication system. The engine's 11 lubricant is pumped to the lubricant receiving well 41, FIG. 7 where it is pumped to the lubricant filtering subsystem 15. The lubricant filtering subsystem 15 filters the lubricant. The lubricant is then pumped to the distribution conduit 42 via valve 45. The engine 11 increases its operation capacity thereby heating the associated coolant. When the engine's 11 coolant is sufficiently heated, the inline thermostat 87, FIG. 2 is activated enabling coolant to circulate about outtake manifold 29 thereby cooling the lubricant. The cooled lubricant is then pumped to the engine's 11 lubrication system.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. Means-plus-function clause is intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

I claim:

1. A lubricant conditioning system operationally connected to an internal combustion engine, the internal combustion engine having a cooling system, an engine lubricant sump, and a lubricant filter housing, the lubricant conditioning system, comprising:

a) a thermal conditioning subsystem in fluid communication with the internal combustion engine's cooling system;

b) a lubricant filtering subsystem adjacently spaced from said thermal conditioning subsystem;

c) a lubricant distribution subsystem mounted to the internal combustion engine's lubricant filter housing;

d) said lubricant distribution subsystem in fluid communication with the lubricant filtering subsystem;

e) a thermally controlled conduit operationally connected to said lubricant distribution subsystem via the internal combustion engine's lubricant sump;

f) a thermally controlled outtake manifold mounted within said thermal conditioning subsystem, said thermally controlled outtake manifold in fluid communication with said lubricant filtering subsystem;

g) said thermally controlled outtake manifold being thermally conditioned via the internal combustion engine's cooling system;

whereby said lubricant filtering subsystem receives lubricant from said lubricant distribution subsystem via said thermally controlled conduit, said thermal conditioning subsystem thermally conditions the received lubricant via said thermally controlled outtake manifold wherein said lubricant distribution subsystem returns the thermally conditioned lubricant to the internal combustion engine.

2. A lubricant conditioning system as recited in claim 1 further comprising a universal adapter for mounting said lubricant distribution subsystem to the internal combustion engine's lubricant filter housing.

3. A lubricant conditioning system as recited in claim 2 wherein said thermally controlled conduit being constructed from flexible conduit.

4. A lubricant conditioning system as recited in claim 3 wherein the internal combustion engine's coolant envelopes said outtake manifold.

5. A lubricant conditioning system as recited in claim 4 wherein said lubricant filtering subsystem comprises:

a) a lubricant intake manifold housing having a lubricant intake port;

b) said lubricant intake manifold housing having an intake flange for receiving at least one lubricant filter; and c) said lubricant intake manifold housing having an outtake flange mounted to at least one received lubricant filter, said outtake flange connected to said thermally controlled outtake manifold.

6. A lubricant conditioning system as recited in claim 5 wherein said lubricant intake manifold's intake flange receives at least one inverted filter.

7. A lubricant conditioning system as recited in claim 5 wherein said thermal conditioning subsystem having an adjustable thermostat is connected between said thermal conditioning subsystem and the internal combustion engine's coolant system.

8. A lubricant conditioning system as recited in claim 7 wherein said lubricant distribution subsystem comprises:

a) a substantially cylindrical housing having a first end and a second end oppositely spaced from said first end, said first end is adapted to the internal combustion engine's lubricant filter housing;

b) said substantially cylindrical housing having a portion of its interior walls forming a lubricant receiving chamber, said lubricant receiving chamber adjacently spaced from the lubricant filter housing;

c) said lubricant receiving chamber in fluid communication with said lubricant intake manifold;

d) a tubular conduit having a first end and a second end oppositely spaced from said first end, said first end sealably traversing said lubricant receiving chamber, said tubular conduit's first end is connected to the lubricant filter housing;

e) a first lubricant flow actuator having a first port and a second port oppositely spaced from said first port, said first port connecting to said tubular conduit's second end;

f) a lubricant receiving housing, said lubricant receiving housing having internal walls forming a lubricant receiving chamber;

g) said first lubricant flow actuator's second port is connected to the interior of said lubricant receiving chamber;

h) a second lubricant flow actuator having a first port and a second port oppositely spaced from said first port, said first port connecting to said tubular conduit, said first port in fluid communication with said thermally controlled outtake manifold, said second port is connected to the interior of said lubricant receiving chamber;

i) a third lubricant flow actuator having a first port and a second port oppositely spaced from said first port, said first port connecting to the interior of said lubricant receiving chamber, said third flow actuators second port connecting to a lubricant drain conduit;

j) a pump having an intake port connected to the engine lubricant sump via a second tubular conduit; and k) said pump having an outtake port connected to the interior of said lubricant receiving chamber.

9. A lubricant conditioning system as recited in claim 8 wherein said second tubular conduit extends into the engine's lubricant sump.

10. A lubricant conditioning system as recited in claim 9 wherein said second tubular conduit having a thermally controlled blanket mounted thereabout.

11. An apparatus for facilitating the thermal conditioning, filtering and evacuation of lubricant for an internal combustion engine, the internal combustion engine having a cooling system, an engine lubricant sump, and a lubricant filter housing, the apparatus comprises:

a) a substantially cylindrical housing having a first end and a second end oppositely spaced from said first end, said first end is adapted to the engine lubricant filter housing;

b) said substantially cylindrical housing having a portion of its interior walls forming a lubricant receiving chamber, said lubricant receiving chamber adjacently spaced from the lubricant filter housing;

c) said lubricant receiving chamber having a lubricant intake port and a lubricant outtake port;

d) a lubricant distribution conduit having a first end coaxially positioned to said lubricant receiving chamber, said first end connected to the lubricant filter housing, said lubricant distribution conduit having a second end connected to a directional valve-pump mechanism;

e) said directional valve-pump mechanism having its pump portion connected to a thermally responsive tubular conduit, said thermally responsive tubular conduit operatively connected to the engine lubricant sump;

f) said directional valve-pump mechanism having its directional valve portion connected to a lubricant sump drain;

g) a substantially rectangular housing having a lubricant intake port and a lubricant outtake port;

h) an intake manifold is mounted within said substantially rectangular housing, said intake manifold connected to said substantially rectangular housing's intake port;

i) an outtake manifold adjacently spaced to said intake manifold within said substantially rectangular housing;

j) said outtake manifold is connected to said substantially rectangular housing outtake port;

k) said receiving chamber's outtake port is connected to said substantially rectangular housing's intake port;

l) said lubricant distribution conduit having an intake port medially spaced between said lubricant distribution conduit's first and second ends;

m) a valve having one side connecting to said lubricant distribution conduit's intake port, the other side of the valve is connected to said substantially rectangular housing's outtake port;

n) said intake manifold in fluid communication with said lubricant receiving chamber;

o) said outtake manifold in fluid communication with said lubricant distribution conduit;

p) said intake manifold having a pair of filter receiving flanges mounted thereon;

q) a pair of tubular extensions mounted on said outtake manifold, said tubular extensions sized to receive at least one filter;

r) a thermally controlled blanket surrounds said outtake manifold, said thermally controlled blanket in thermal communication with the internal combustion engine's cooling system;

whereby the thermally conditioned lubricant pumped from the engine's lubricant sump being directionally controlled, said directional flow valve directing the engine lubricant to said engine lubricant sump drain or to said engine lubricant sump via the thermally controlled outtake manifold.

12. A lubricant conditioning system operationally connected to an internal combustion engine, the internal combustion engine having an engine lubricant sump, and a lubricant filter housing, the lubricant conditioning system, comprising:

a) a selected heat exchanger;

b) a lubricant filtering subsystem mounted to said selected heat exchanger;

c) a lubricant distribution subsystem mounted to the internal combustion engine's lubricant filter housing;

d) said lubricant distribution subsystem in fluid communication with said selected heat exchanger, said selected heat exchanger thermally conditioning the lubricant;

e) said lubricant filtering subsystem receiving thermally conditioned lubricant from said heat exchanger;

whereby said lubricant filtering subsystem returns the thermally conditioned and filtered lubricant to the internal combustion engine.

13. A lubricant conditioning system as recited in claim 12 further comprising a universal adapter for mounting said lubricant distribution subsystem to the internal combustion engine's lubricant filter housing.

14. A lubricant conditioning method for controlling the temperature, viscosity and filtering of lubricant of an internal combustion engine, the internal combustion engine having operatively connected therein an engine cooling system, an engine lubricant sump, and a lubricant filter housing, a provided thermal conditioning subsystem is in fluid communication with the internal combustion engine's cooling system, a provided lubricant filtering subsystem is adjacently spaced from the thermal conditioning subsystem, a provided lubricant distribution subsystem is mounted to the internal combustion engine's lubricant filter housing, the lubricant distribution subsystem is in fluid communication with the lubricant filtering subsystem, a provided thermally controlled outtake manifold is mounted within the thermal conditioning subsystem, the thermally controlled outtake manifold is in fluid communication with the lubricant filtering subsystem, the lubricant conditioning system comprising the steps of:

a) energizing the lubricant distribution subsystem;

b) receiving lubricant to the lubricant filtering subsystem via said energized lubricant distribution subsystem;

c) filtering the received lubricant;

d) controlling the thermal aberrations of the thermal conditioning subsystem's coolant;

e) receiving lubricant via the thermally controlled outtake manifold;

f) controlling the thermal aberration of the lubricant via the thermally controlled outtake manifold; and g) distributing lubricant to the engine via the lubricant distribution subsystem.

15. A lubricant conditioning system as recited in claim 14 further comprising the step of:

a) energizing a thermally controlled conduit connected within the engine's lubricant sump; and b) evacuating the lubricant from the engine's lubricant sump.

16. A lubricant conditioning system as recited in claim 15 wherein said energizing the lubricant distribution subsystem comprises the step of activating a switch controlling the pump-valve mechanism.

17. A lubricant conditioning system as recited in claim 16 wherein said controlling the thermal aberrations of the thermal conditioning subsystem comprises the step of selecting a thermal elevation of the engine's coolant circulating about the thermally controlled outtake manifold.

* * * * *